US011766126B1

(12) United States Patent
Yang

(10) Patent No.: US 11,766,126 B1
(45) Date of Patent: Sep. 26, 2023

(54) HIGHLY STEADY ROTARY CHAIR

(71) Applicant: Xuanbin Yang, Nanjing (CN)

(72) Inventor: Xuanbin Yang, Nanjing (CN)

( * ) Notice: Subject to any disclaimer, the term of this patent is extended or adjusted under 35 U.S.C. 154(b) by 0 days.

(21) Appl. No.: 17/691,456

(22) Filed: Mar. 10, 2022

(51) Int. Cl.
*A47C 3/18* (2006.01)
*A47C 4/02* (2006.01)
*A47C 7/00* (2006.01)

(52) U.S. Cl.
CPC ..... *A47C 3/18* (2013.01); *A47C 4/02* (2013.01); *A47C 7/004* (2013.01)

(58) Field of Classification Search
CPC ..... A47C 3/025; A47C 3/0252; A47C 3/18; A47C 7/004
USPC ..... 297/344.21, 440.22; 108/157.15, 157.17, 108/157.18, 159; 248/188, 188.1, 188.7
See application file for complete search history.

(56) References Cited

U.S. PATENT DOCUMENTS 464,618 A * 12/1891 Wheeler ..... A47C 7/004 248/188.7
1,637,846 A * 8/1927 Adams ..... A47C 3/18 297/440.22
1,694,617 A * 12/1928 Brown ..... A47C 3/24 248/188.7
1,864,535 A * 6/1932 Hach ..... A47C 3/24 248/188.7
3,197,165 A * 7/1965 Gits ..... A47C 3/24 248/188.7
3,589,772 A * 6/1971 Leaver ..... A47C 7/004 297/451.3
3,593,954 A * 7/1971 Ritchie ..... A47C 3/18 297/344.21
3,829,157 A * 8/1974 Lange, Jr. ..... A47C 7/44 297/268.1
4,169,625 A * 10/1979 Petersen ..... A47C 7/004 297/440.22 X
4,183,494 A * 1/1980 Cleveland ..... A47C 3/0252 297/268.1

(Continued)

FOREIGN PATENT DOCUMENTS

DE 20201252 U1 * 4/2002 ..... A47B 13/023
GB 1046574 A * 10/1966 ..... A47C 3/0252

(Continued)

*Primary Examiner* — Rodney B White
(74) *Attorney, Agent, or Firm* — Chun-Ming Shih; LANWAY IPR SERVICES

(57) ABSTRACT

The present disclosure provides a highly steady rotary chair, and relates to the technical field of rotary chairs, which solves the technical problems that in the rotary chair in the prior art, a fully-welded base plate causes a product to have an extremely large packaging volume and higher production and sales cost. The highly steady rotary chair includes a rotary chair body and a rotary chair base. The rotary chair base includes a bottom ring, a supporting rod, a rotating shaft tray, a rotating shaft, a rotating shaft connector, and a chair seat connecting steel plate which are detachably connected in sequence from bottom to top; and the rotary chair body and the rotary chair base are detachably connected through the chair seat connecting steel plate. The present disclosure is used to provide the highly steady rotary chair with a detachable base plate and has the advantages of reducing the packaging cost and improving the product loading capacity.

5 Claims, 2 Drawing Sheets

(56) References Cited

U.S. PATENT DOCUMENTS 4,319,729 A * 3/1982 Lo ..... A47B 13/023 248/188.7
4,830,324 A * 5/1989 Neville ..... A47C 3/18 297/344.21
4,911,501 A * 3/1990 Decker ..... A47C 3/0252 297/285
4,971,394 A * 11/1990 Vanderminden ..... A47C 3/026 297/344.21
5,046,780 A * 9/1991 Decker ..... A47C 1/03255 297/300.1
5,383,644 A * 1/1995 Huse ..... F16M 11/041 248/501
5,505,524 A * 4/1996 Drumwright ..... A47C 7/004 297/440.24 X
5,599,064 A * 2/1997 Vanderminden, Sr. ..... A47C 7/445 297/344.21
5,988,754 A * 11/1999 Lamart ..... A47C 7/004 248/161
6,048,029 A * 4/2000 Percoco ..... A47C 3/026 297/344.21
6,361,111 B1 * 3/2002 Bowers ..... A47C 3/18 297/344.22
6,553,921 B2 * 4/2003 Liu ..... A47B 13/06 108/157.15
6,719,252 B2 * 4/2004 Cheng ..... A47B 13/003 248/188
6,827,401 B2 * 12/2004 Marshall ..... A47C 1/03255 297/325
6,913,317 B2 * 7/2005 Vanderminden ..... A47C 3/0252 297/344.21
6,918,563 B2 * 7/2005 Tseng ..... F16M 11/38 248/188.7
7,866,751 B2 * 1/2011 Downey ..... B60N 2/0296 297/344.21
9,004,586 B2 * 4/2015 DeCraene ..... B60N 2/146 297/440.22
11,617,442 B2 * 4/2023 Ramon ..... A47C 3/0255 297/259.1
2002/0140274 A1 * 10/2002 Gien ..... A47C 7/004 297/445.1
2002/0185900 A1 * 12/2002 Lin ..... A47C 3/026 297/344.1
2005/0150431 A1 * 7/2005 Lijian ..... A47B 13/083 108/27
2008/0030057 A1 * 2/2008 Tai ..... A47C 7/004 297/300.4
2015/0238014 A1 * 8/2015 Kessler ..... A47C 7/004 248/188.1 X
2015/0366351 A1 * 12/2015 Besler ..... A61G 5/14 297/344.21
2019/0045929 A1 * 2/2019 Walker ..... A47C 7/006
2019/0200768 A1 * 7/2019 Keilhauer ..... A47C 7/006
2023/0103950 A1 * 4/2023 Sugano ..... A47C 3/026 297/259.3
2023/0108179 A1 * 4/2023 Hayashi ..... A47C 3/027 297/259.3
2023/0109498 A1 * 4/2023 Hayashi ..... A47C 9/002 297/259.3

FOREIGN PATENT DOCUMENTS

GB 2524961 A * 10/2015 ..... A47C 3/18
WO WO-9829008 A1 * 7/1998 ..... A47C 3/0252

* cited by examiner

HIGHLY STEADY ROTARY CHAIR

TECHNICAL FIELD

The present disclosure relates to the technical field of rotary chairs, in particular to a highly steady rotary chair.

BACKGROUND ART

A rotary chair is a chair with a rotatable sitting part. It can be divided into two types: a half-rotary chair and a full-rotary chair. It is a common leisure furniture product.

The applicant found that in the prior art, the structure of a base plate of the rotary chair generally adopts a fully welding method. Such a welding method has certain defects. A fully-welded base plate will lead to an extremely large packaging volume of a product, high factory cost and extremely high sale price of the product. Therefore, a new base plate design structure is required, which can reduce the packaging cost of the product and further increase the product loading capacity, and the stability of the product after assembly also meets the requirements of customers.

To sum up, the prior art has at least the following technical problems:

In the rotary chair provided in the prior art, the fully welded base plate causes the product to have an extremely large packaging volume and higher production and sales cost.

SUMMARY

The present disclosure aims to provide a highly steady rotary chair, which solves the technical problems that in a rotary chair in the prior art, a fully-welded base plate causes a product to have an extremely large packaging volume and higher production and sales cost.

In order to achieve the forgoing purpose, the present disclosure provides the following technical solution.

A highly steady rotary chair of an embodiment of the present disclosure includes a rotary chair body and a rotary chair base.

The rotary chair base includes a bottom ring, a supporting rod, a rotating shaft tray, a rotating shaft, a rotating shaft connector, and a chair seat connecting steel plate which are detachably connected in sequence from bottom to top; and the rotary chair body and the rotary chair base are detachably connected through the chair seat connecting steel plate.

In an optional embodiment, a bottom end of the supporting rod is detachably connected to an inner wall of the bottom ring; and the rotating shaft tray is detachably connected to a top end of the supporting rod.

In an optional embodiment, the rotating shaft tray includes a connecting plate and a sleeve which are integrally formed.

In an optional embodiment, the number of the supporting rods is three, and an angle of 120 degrees is formed between every two of the supporting rods.

In an optional embodiment, the top end of each supporting rod is provided with a connecting block integrally formed with the supporting rod, and each connecting block is detachably connected to the connecting plate.

In an optional embodiment, the rotating shaft is detachably inserted to the rotating shaft tray; the rotating shaft connector is detachably inserted to a top of the rotating shaft; and the chair seat connecting steel plate is detachably connected to a top of the rotating shaft connector.

In an optional embodiment, the rotary chair body includes a rotary chair seat, armrests arranged on two sides of the rotary chair seat, and a rotary chair back arranged behind the rotary chair seat.

In an optional embodiment, the rotary chair body is detachably connected to the chair seat connecting steel plate through the rotary chair seat.

Based on the above-mentioned technical solution, the embodiment of the present disclosure can at least achieve the following technical effects:

In the prior art, the structure of a base plate of the rotary chair generally adopts a full welding method. Such a welding method has certain defects. A fully-welded base plate will lead to an extremely large packaging volume of a product, high factory cost and extremely high sale price of the product.

Compared with the prior art, the present disclosure optimizes the structure of the base plate of the rotary chair. The bottom ring, the supporting rod, the rotating shaft tray, the rotating shaft, the rotating shaft connector, and the chair seat connecting steel plate which are detachably connected in sequence are arranged on the rotary chair base from bottom to top, and finally, the rotary chair body and the rotary chair base are detachably connected through the chair seat connecting steel plate. The rotary chair body and the rotary chair base achieve relative rotation through the rotating shaft, so that the base plate of the rotary chair can be disassembled into a plurality of separate parts, which reduces the packaging volume, reduces the factory cost and the production and logistics cost and is favorable for reducing the sale price. Therefore, the technical problems that in the rotary chair in the prior art, a fully-welded base plate causes a product to have an extremely large packaging volume and higher production and sales cost.

BRIEF DESCRIPTION OF THE DRAWINGS

In order to explain the technical solutions of the embodiments of the present disclosure more clearly, the following will briefly introduce the accompanying drawings used in the description of the embodiments. Apparently, the drawings in the following description are only embodiments of the present disclosure. Those of ordinary skill in the art can obtain other drawings based on these drawings without creative work.

Figure 1:
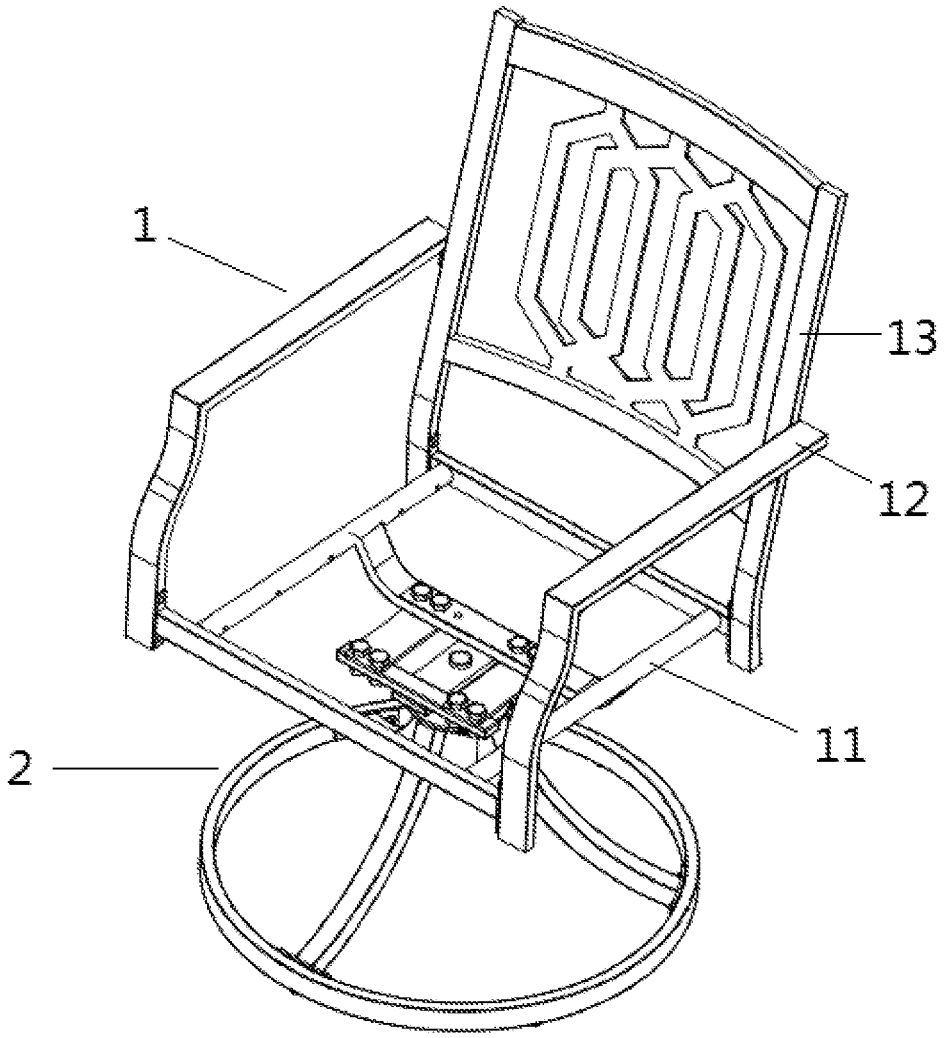
FIG. 1 is a schematic three-dimensional diagram of a highly steady rotary chair provided by an embodiment of the present disclosure.

Reference signs in the drawings: 1: rotary chair body; 11: rotary chair seat; 12: armrest; 13: rotary chair back; 2: rotary chair base; 21: bottom ring; 22: supporting rod; 23: rotary shaft tray; 24: rotating shaft; 25: rotating shaft connector; and 26: chair seat connecting steel plate.

DETAILED DESCRIPTION OF THE EMBODIMENTS

In order to make the purposes, technical solutions and advantages of the present disclosure clearer, the technical solutions of the present disclosure will be described in detail below. It is apparent that the described embodiment is only one of the embodiments of the present disclosure, not all the embodiments. Based on the embodiments in the present disclosure, all other embodiments obtained by those of ordinary skill in the art without creative efforts shall fall within the protection scope of the present disclosure.

An embodiment of the present disclosure provides a highly steady rotary chair.

The technical solution provided by the present disclosure is described in more details below in combination with FIG. 1 to FIG. 2.

Figure 2:
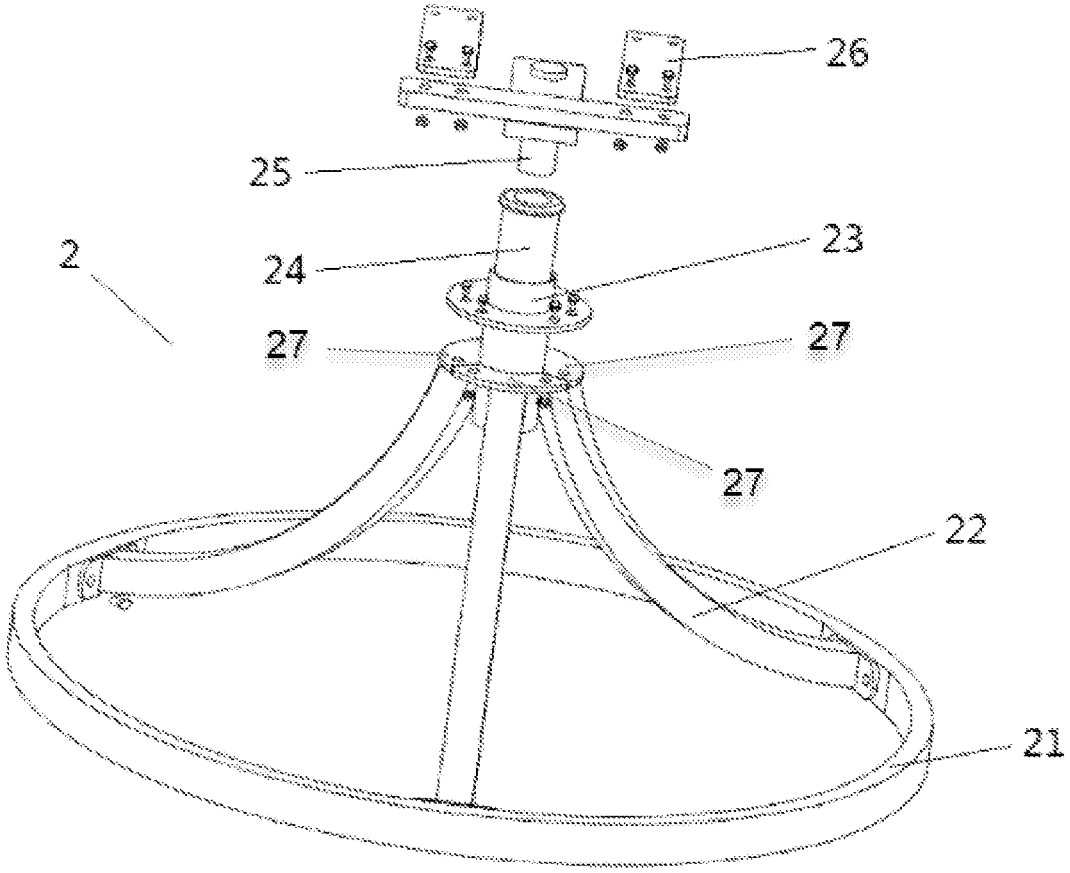
FIG. 2 is a schematic three-dimensional diagram of a rotary chair base provided by an embodiment of the present disclosure.

As shown in FIG. 1 to FIG. 2, the highly steady rotary chair provided in an embodiment of the present disclosure includes a rotary chair body 1 and a rotary chair base 2.

The rotary chair base 2 includes a bottom ring 21, a supporting rod 22, a rotating shaft tray 23, a rotating shaft 24, a rotating shaft connector 25, and a chair seat connecting steel plate 26 which are detachably connected in sequence from bottom to top. The rotary chair body 1 and the rotary chair base 2 are detachably connected through the chair seat connecting steel plate 26.

In the prior art, the structure of a base plate of the rotary chair generally adopts a full welding method. Such a welding method has certain defects. A fully-welded base plate will lead to an extremely large packaging volume of a product, high factory cost and extremely high sale price of the product.

Compared with the prior art, the present disclosure optimizes the structure of the base plate of the rotary chair. The bottom ring 21, the supporting rod 22, the rotating shaft tray 23, the rotating shaft 24, the rotating shaft connector 25, and the chair seat connecting steel plate 26 which are detachably connected in sequence are arranged on the rotary chair base 2 from bottom to top, and finally, the rotary chair body 1 and the rotary chair base 2 are detachably connected through the chair seat connecting steel plate 26. The rotary chair body 1 and the rotary chair base 2 achieve relative rotation through the rotating shaft 24, so that the base plate of the rotary chair can be disassembled into a plurality of separate parts, which reduces the packaging volume, reduces the factory cost and the production and logistics cost and is favorable for reducing the sale price. Therefore, the technical problems that in the rotary chair in the prior art, a fully-welded base plate causes a product to have an extremely large packaging volume and higher production and sales cost.

As an optional implementation mode, a bottom end of the supporting rod 22 is detachably connected to an inner wall of the bottom ring 21. The rotating shaft tray 23 is detachably connected to a top end of the supporting rod 22. The above structure is convenient for machining and manufacturing. Specifically, the bottom end of the supporting rod 22 is fixedly connected to the inner wall of the bottom ring 21 through a screw, and the rotating shaft tray 23 is fixedly connected to the top end of the supporting rod 22 through a screw.

As an optional implementation mode, the rotating shaft tray 23 includes a connecting plate and a sleeve which are integrally formed. The above structure is convenient for machining and manufacturing. The connecting plate is welded on the sleeve.

As an optional implementation mode, the number of the supporting rods 22 is three, and an angle of 120 degrees is formed between every two of the supporting rods 22. The above structure is convenient for machining and manufacturing and is favorable for stabilizing the chair. Of course, the number of the supporting rods 22 can be adjusted according to a need.

As an optional implementation mode, the top end of each supporting rod 22 is provided with a connecting block 27 integrally formed with the supporting rod 22, and each connecting block 27 is detachably connected to the connecting plate. The above structure is convenient for machining and manufacturing. A circular ring encircled by the three connecting blocks 27 is basically consistent with the connecting plate in structural size. Specifically, each connecting block 27 and the connecting plate are fixedly connected through a screw, thus achieving the detachable connection between the supporting rods 22 and the rotating shaft tray 23.

In this way, when the rotary chair body 1 shakes front and back or left and right, and a force is transmitted from the rotating shaft tray 23 to the supporting rods 22, the force is transmitted in a plane-to-plane form between the connecting plate and the connecting block 27, which reduces the risk of tipping over of the chair.

As an optional implementation mode, the rotating shaft 24 is detachably inserted to the rotating shaft tray 23. The rotating shaft connector 25 is detachably inserted to a top of the rotating shaft 24. The chair seat connecting steel plate 26 is detachably connected to a top of the rotating shaft connector 25. The above structure is convenient for machining and manufacturing. Specifically, the rotating shaft tray 23 clamps the rotating shaft 24. The rotating shaft 24 clamps the rotating shaft connector 25. The chair seat connecting steel plate 26 is fixedly connected to the top of the rotating shaft connector 25 through a screw.

As an optional implementation mode, the rotary chair body 1 includes a rotary chair seat 11, armrests 12 arranged on two sides of the rotary chair seat 11, and a rotary chair back 13 arranged behind the rotary chair seat 11. The above structure is convenient for machining and manufacturing. Two sides of the rotary chair back 13 resist against the inner sides of the armrests 12.

As an optional implementation mode, the rotary chair body 1 is detachably connected to the chair seat connecting steel plate 26 through the rotary chair seat 11. The above structure is convenient for machining and manufacturing. Specifically, a cross beam detachably connected to the chair seat connecting steel plate 26 is arranged on the rotary chair seat 11.

Compared with the prior art, the present disclosure has the following outstanding advantages and effects: By means of the detachable design of the rotary chair base 2 in the present disclosure, the rotary chair base 2 is different from a traditional welded base. The detachable design causes a product to have a reduced packaging volume and have advantages of reducing the packaging cost and improving the product loading capacity. By means of the design that the bottom ring 21 is connected to a periphery of the supporting rod 22, the supporting rod 22 is reinforced and stabilized, which improves the steadiness of the rotary chair.

The above are only specific embodiments of the present invention, but the protection scope of the present invention is not limited thereto. Any person skilled in the art who is familiar with the technical scope disclosed by the present invention can easily think of changes or substitutions. All should be included within the protection scope of the present invention. Therefore, the protection scope of the present disclosure should be subject to the protection scope of the claims.

In the description of the present disclosure, it should be noted that unless otherwise stated, "plurality" means two or more. Orientations or positional relationships indicated by the terms "upper", "lower", "left", "right", "inside", "outside", "front end", "rear end", "head", "tail" and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are construed as limiting the present disclosure. In addition, the terms "first", "second", "third", etc. are only for the purpose of description, and may not be understood as indicating or implying the relative importance.

In the description of the present disclosure, it should be further noted that unless otherwise explicitly defined and defined, the terms "mounted", "coupled" and "connected" are to be understood broadly, and may be, for example, fixedly connected, or detachably connected, or integrally connected, or mechanically connected, or electrically connected, or directly connected, or indirectly connected through an intermediate medium. Those of ordinary skill in the art can understand the specific meanings of the above terms in the present disclosure according to specific situations.

What is claimed is:

1. A highly steady rotary chair, comprising a rotary chair body and a rotary chair base, wherein the rotary chair base comprises a bottom ring, a plurality of supporting rods each integrally formed with a connecting block at a top end, a rotating shaft tray comprising a connecting plate, a rotating shaft, a rotating shaft connector, and a chair seat connecting steel plate, which are detachably connected in sequence from bottom to top, so that the rotary chair base is capable of being disassembled into a plurality of separate parts; and the rotary chair body and the rotary chair base are detachably connected through the chair seat connecting steel plate;

a bottom end of each supporting rod is fixedly connected to an inner wall of the bottom ring through a first screw, and the connecting block is fixedly connected to the connecting plate through a second screw.

2. The highly steady rotary chair according to claim 1, wherein a number of the supporting rods is three, and an angle of 120 degrees is formed between every two of the supporting rods.

3. The highly steady rotary chair according to claim 1, wherein the rotating shaft is detachably inserted to the rotating shaft tray; the rotating shaft connector is detachably inserted to a top of the rotating shaft; and the chair seat connecting steel plate is detachably connected to a top of the rotating shaft connector.

4. The highly steady rotary chair according to claim 1, wherein the rotary chair body comprises a rotary chair seat, armrests arranged on two sides of the rotary chair seat, and a rotary chair back arranged behind the rotary chair seat.

5. The highly steady rotary chair according to claim 4, wherein the rotary chair body is detachably connected to the chair seat connecting steel plate through the rotary chair seat.

* * * * *